United States Patent [19]

Aldinio

[11] Patent Number: 4,620,380

[45] Date of Patent: Nov. 4, 1986

[54] SKI BOOT INCORPORATING A FLEX CONTROL DEVICE

[75] Inventor: Giuseppe Aldinio, Treviso, Italy

[73] Assignee: Nordica S.p.A., Montebelluna, Italy

[21] Appl. No.: 701,045

[22] Filed: Feb. 12, 1985

[30] Foreign Application Priority Data

Feb. 28, 1984 [IT] Italy ..... 19833 A/84

[51] Int. Cl.[4] ..... A43B 5/04

[52] U.S. Cl. ..... 36/121; 36/119

[58] Field of Search ..... 36/117–121, 36/3 R, 3 A, 45, 93

[56] References Cited

U.S. PATENT DOCUMENTS 3,786,581 1/1974 Mochizuki ..... 36/121
3,988,842 11/1976 Rathmell ..... 36/121

FOREIGN PATENT DOCUMENTS 2456612 6/1975 Fed. Rep. of Germany ..... 36/93
2496423 6/1982 France ..... 36/119
2539278 7/1984 France ..... 36/117

*Primary Examiner*—James Kee Chi
*Attorney, Agent, or Firm*—Guido Modiano; Albert Josif

[57] ABSTRACT

The invention is concerned with a ski boot which incorporates a flex control device and comprises a boot shell having a quarter associated therewith mounted for a rocking movement about a horizontal axis lying perpendicularly to the longitudinal direction of the shell. A peculiar feature of the invention is that it comprises an elastically deformable chamber containing an elastically compressible fluid, which chamber is located between the shell and quarter, and in particular between a front upper portion of the shell and the front lower edge of the quarter. Said chamber may be connected to a pumping means directly attached to the boot and establishing a presettable pressure level within said chamber.

8 Claims, 3 Drawing Figures

SKI BOOT INCORPORATING A FLEX CONTROL DEVICE

BACKGROUND OF THE INVENTION

This invention relates to a ski boot incorporating a flex control device.

Ski boots, and especially rear entrance ski boots, are known to include some device for controlling flex, flex meaning here the resistance opposed by the boot to bending about a substantially horizontal axis lying perpendicularly to the boot shell longitudinal direction.

Currently known, e.g. from U.S. Pat. No. 3,713,231, are devices for controlling flex which comprise a spring cushioning member which acts, with an adjustable spring bias action, between the shell and quarter to provide elastic resistance to bending.

That approach, while being satisfactory from a theoretical point of view, mainly has the disadvantage of requiring complex constructional parts which are difficult to mount on the boot and not always easily set by the user.

Another disadvantage is that such devices are relatively bulky, which adversely affects the aesthetic appearance of the boot to an appreciable extent, while increasing the outline dimensions of the boot.

Another proposal, e.g. as provided by U.S. Pat. No. 3,968,578, employs a replaceable elastomeric element which is applied between the shell and quarter to resist oscillation elastically.

The elastomeric element affords an improved fit to the general appearance of the boot by avoiding a bulging outline, but has the disadvantage that it must be replaced whenever the boot flex is to be altered.

In practice, therefore, a satisfactory boot is provided from the aesthetical standpoint but one that is inconvenient for the user who has to remove and replace parts, in particular the elastomeric element, if he/she desires to alter the boot flex, thereby the amount of flex cannot be adjusted continuously and quickly.

SUMMARY OF THE INVENTION

It is an aim of this invention to obviate such shortcomings affecting the prior art by providing a ski boot incorporating a flex control device which can combine the advantages discussed above in connection with prior ski boots but has none of their disadvantages.

Within the above aim, it is a particular object of the invention to provide a ski boot incorporating a flex control device, which enables the user to adjust the settable flex value continuously, without involving any complex operations.

A further object of this invention is to provide a ski boot wherein the flex control device perfectly fits the boot outline and forms no outward bulging volumes.

The above aim, and these and other objects such as will be apparent hereinafter, are achieved by a ski boot incorporating a flex control device, according to the invention, and comprising a shell having, associated thereto for a rocking movement about a substantially horizontal axis lying substantially perpendicularly to the shell longitudinal direction, at least one quarter movable relative to the shell, characterized in that it comprises, interposed between an edge formation of said quarter and an edge portion of said shell, an inflatable chamber containing an elastically compressible fluid, said chamber being connectable to a pumping means for establishing a presettable pressure level within said chamber.

BRIEF DESCRIPTION OF THE DRAWING

Further features and advantages will be more readily apparent from the following description of a preferred but not exclusive embodiment of a ski boot incorporating a flex control device, with reference to the accompanying illustrative drawing, where.

DESCRIPTION OF THE PREFERRED EMBODIMENTS

Figure 2:
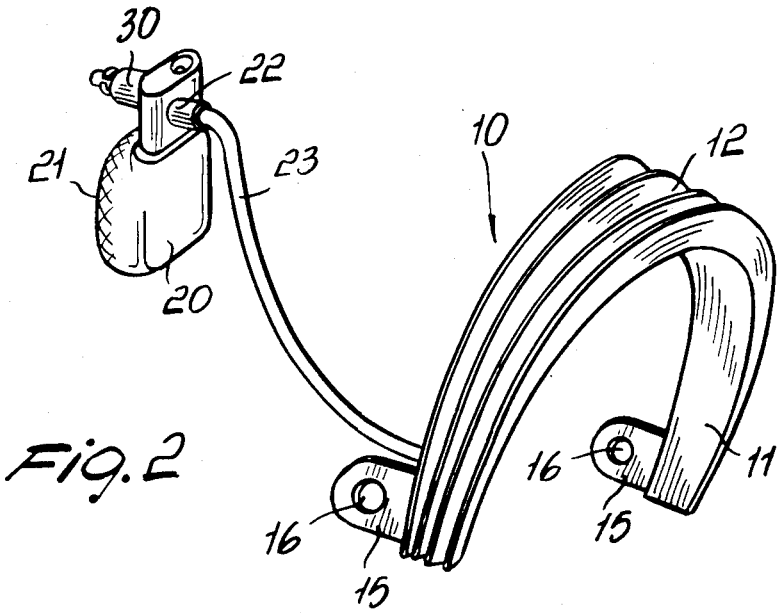
FIG. 2 is a perspective view showing diagrammatically the flex control device.
Figure 3:
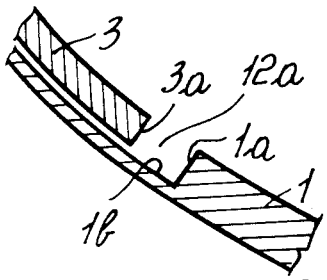
FIG. 3 shows a fragmentary section according to line III—III of FIG. 1.
Figure 1:
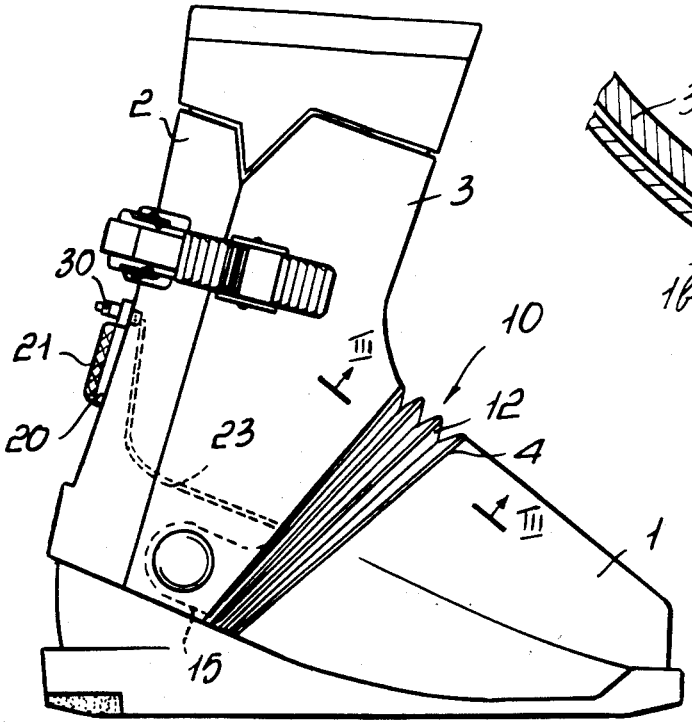
FIG. 1 shows the ski boot of this invention as incorporating the device for controlling its flex.

With reference to the drawing figures, a ski boot according to this invention is shown to comprise a shell generally designated with the reference numeral 1, with which there are pivotally associated a rear quarter 2 and a front quarter 3 mounted for a pivotal movement about a common substantially horizontal axis that lies substantially perpendicular to the boot main extension. The facing edge portions of the front or rear quarters, slidably overlap each other to allow relative movement thereof, as is well known in the art.

A peculiar feature of the invention is that between the front lower edge of the quarter 3 and a front upper region on the shell, indicated at 4, there intervenes an air hose 10, hereinafter called inflatable chamber or simply chamber, formed from an elastically deformable material.

More specifically, the chamber 10 has a crown or crescent like shape with a substantially smooth bottom face 11 which slidably rests in practice onto the recessed or bottom portion **1*b* of reduced thickness of the front upper region of the shell 1, which forms the bottom of a groove-like seat 12*a* in which the bellows-like hose is arranged. The shoulder-like edges 1*a* and 3*a* of the shell 1 and quarter 3 form the sides of the groove-like seat 12*a*. The edges 1*a* and 3*a* are rising abutment edges for the side portions of the inflatable chamber 10. The top face 12 of the inflatable chamber is of folded or bellows shape to accommodate the elastic deformation of the hose 10**, as will be explained hereinafter.

It will be understood that when the chamber is compressed, owing to the reduction of the distance between the edges **1*a* and 3*a*** by virtue of the forward lean motion, the smooth bottom thereof assumes an arcuated or undulated shape.

According to a modification the bottom face of the chamber may also have a bellows shape if desired.

At the free ends of the chamber 10 there extend small ears 15 having a throughgoing hole 16 for engagement by the pivot pin of the quarter(s), thus forming a fastening and locating element for the chamber 10 on the boot.

According to a modification the recessed portion **1*b* may be omitted so that the inflatable chamber 10 is in such case attached only to the edges 1*a*, 3*a***.

The chamber 10 interior contains an elastically compressible fluid which will preferably, but not necessarily, be air.

While the side walls of the chamber 10 may be attached to the edges **1*a* and 3*a*, such as by glueing, it is possible to allow the sides of the chamber 10 simply to rest against the edges 1***a* and 3*a*. In such case it may be foreseen that the abutment surfaces of the edges 1*a* and 3*a* assume a concave, undercut or rifled shape in order to provide an engagement with the pneumatic chamber 10, which will avoid lateral slippage thereof. The bottom of the chamber, while resting on the bottom 1*b* of the seat 12*a* is in slidable relationship therewith, to allow for the relative movement therebetween.

In order to introduce air into the chamber 10, there is provided a pumping means comprising a case 20 having at least one portion 21 thereof elastically yielding to provide a pumping element. Also provided is the usual one-way valving means, as indicated diagrammatically at 22, which will admit the pumped air into the chamber 10 through a conduit 23.

Active on the delivery side of the pump is a venting element 30 which, when operated, allows the air to be vented out from the chamber interior, thereby reducing the pressure in the interior of the chamber.

The above chamber 10 operates in practice similarly to bellows the elastic characteristics whereof are a direct function of the pressure level of the air or compressible fluid admitted into the chamber.

In fact, when the boot stiffness is to be increased, that is when its flex is to be decreased, it will be sufficient to admit air under pressure into the chamber 10 by operating the pump 20, which may advantageously be attached directly to the boot, thus affording for the user readily at hand means of generating the desired pressure within the chamber 10.

It should be further added that it is important that the chamber 10 be firmly attached to the shell and front quarter, such that, under the thrust exerted by the air, the chamber cannot move out of its position, and it is for this purpose that the ears 15 have been provided to practically anchor the chamber 10 to the boot.

The invention disclosed above is susceptible to many modifications and changes without departing from the purview of the inventive concept.

Furthermore, all of the details may be replaced with other, technically equivalent elements.

In practicing the invention, any suitable materials, dimensions and contingent shapes, may be used, to meet individual requirements, providing that they are compatible with the intended application.

I claim:

1. A ski boot incorporating a flex contol device and comprising a shell, associated thereto for rocking movement about an axis substantially perpendicular to the shell longitudinal direction at least one quarter tiltable relative to said shell, said shell having at least one edge portion and said quarter having at least another edge portion, said one edge portion and said another edge portion facing each other at a variable distance depending on the relative position of the quarter and the shell with respect to each other, a pressure fluid inflatable chamber member arranged between said one edge portion and said another edge portion and having one side portion thereof in abutment relationship with said one edge portion and having another side portion thereof in abutment relationship with said another edge portion and pumping means connected to said inflatable chamber member for setting a preestablished fluid pressure level within said inflatable chamber member to thereby control the elastic resistance against deformation of said chamber member and the degree of flex of the ski boot.

2. A ski boot according to claim 1, wherein said one edge portion has a step like shape defining a rising abutment surface and a bottom surface perpendicular thereto and wherein said inflatable chamber member has a crescent-like configuration with a smooth bottom face slidably resting against said bottom surface and an opposite top face having bellows like folds thereon.

3. A ski boot according to claim 1, further comprising means for fastening said inflatable chamber on said boot and wherein said means comprise pivot pins defining a hinging engagement between said shell and said quarter and ear formations at the free ends of said inflatable chamber, said ear formations having through holes for engagement with said pins.

4. A ski boot according to claim 2, further comprising means for fastening said inflatable chamber on said boot, said means including a concave shape at least on said rising abutment surface.

5. A ski boot according to claim 2, further comprising means for fastening said inflatable chamber on said boot, said means including a rifled shape at least on said rising abutment surface

6. A ski boot according to claim 1, wherein said pump means is associated with said ski boot.

7. A ski boot according to claim 1, further comprising a pneumatic circuit including conduit means connecting said pump means with said inflatable chamber and one way valve means between said pump means and said inflatable chamber and controllable vent means.

8. A ski boot incorporating a flex control device and comprising a shell, associated thereto for rocking movement about an axis substantially perpendicular to the shell longitudinal direction at least one quarter tiltable relative to said shell, said shell having at least one edge portion and said quarter having at least another edge portion, said one edge portion and said another edge portion facing each other at a variable distance depending on the relative position of the quarter and the shell with respect to each other, a pressure fluid inflatable chamber member arranged between said one edge portion and said another edge portion and having one side portion thereof in abutment relationship with said one edge portion and having another side portion thereof in abutment relationship with said another edge portion and pumping means connected to said inflatable chamber member for setting a preestablished fluid pressure level within said inflatable chamber member to thereby control the elastic resistance against deformation of said chamber member and the degree of flex of the ski boot and wherein said one edge portion has to step like shape defining a rising abutment surface and a bottom surface perpendicular thereto and wherein said inflatable chamber member has a crescent-like configuration with a smooth bottom face slidably resting against said bottom surface and an opposite top face having bellows like folds thereon, means for fastening said inflatable chamber on said boot and wherein said fastening means comprise pivot pins defining a hinging engagement between said shell and said quarter and ear formations at the free ends of said inflatable chamber, said ear formations having through holes for engagement with said pins, said pump means being associated with said ski boot, pneumatic circuit means including conduit means connecting said pump means with said inflatable chamber and one way valve means between said pump means and said inflatable chamber and controllable vent means.

* * * * *